US011022137B2

(12) United States Patent
Ohno et al.

(10) Patent No.: US 11,022,137 B2
(45) Date of Patent: Jun. 1, 2021

(54) FAN DEVICE

(71) Applicant: MINEBEA MITSUMI Inc., Nagano (JP)

(72) Inventors: Yuma Ohno, Hamamatsu (JP); Yuji Omura, Shizuoka (JP)

(73) Assignee: MINEBEA MITSUMI INC., Nagano (JP)

( * ) Notice: Subject to any disclaimer, the term of this patent is extended or adjusted under 35 U.S.C. 154(b) by 0 days.

(21) Appl. No.: 16/919,224

(22) Filed: Jul. 2, 2020

(65) Prior Publication Data

US 2021/0010484 A1 Jan. 14, 2021

(30) Foreign Application Priority Data

Jul. 8, 2019 (JP) ..... JP2019-126657
Jan. 9, 2020 (JP) ..... JP2020-001901

(51) Int. Cl.
*F04D 29/32* (2006.01)
*F04D 29/58* (2006.01)

(52) U.S. Cl.
CPC ..... *F04D 29/329* (2013.01); *F04D 29/584* (2013.01)

(58) Field of Classification Search
CPC .. F04D 29/329; F04D 29/584; F04D 29/5806; F04D 29/5813; F04D 25/0613; F04D 25/082; F04D 19/002
See application file for complete search history.

(56) References Cited

U.S. PATENT DOCUMENTS 6,951,449 B2 * 10/2005 Huang ..... F04D 29/584 417/368
7,701,097 B2 * 4/2010 Lan ..... F04D 25/0613 310/61
7,997,862 B2 * 8/2011 Li ..... F04D 29/526 415/211.2
8,246,329 B2 * 8/2012 Li ..... F04D 29/329 417/423.9
8,403,651 B2 * 3/2013 Hsu ..... F04D 25/0613 417/423.1
8,784,075 B2 * 7/2014 Moreau ..... H02K 7/14 417/366
2007/0013242 A1 * 1/2007 Tung ..... F04D 25/064 310/67 R (Continued)

FOREIGN PATENT DOCUMENTS

GB 2160924 A * 1/1986
JP 2006-177309 A 7/2006

*Primary Examiner* — Hung Q Nguyen
(74) *Attorney, Agent, or Firm* — Pearne & Gordon LLP

(57) ABSTRACT

A fan device 1 includes a second housing 12 and a hub 27. The hub 27 includes a hub body part 272 and a hub outer peripheral wall part 271. The hub body part 272 is a surface extending in the radial direction orthogonal to the direction of the axis x, and the hub body part 272 covers the motor 20 from the upper side "a" in the direction of an axis c. The hub outer peripheral wall part 271 extends from the end portion of the hub body part 272 toward the lower side "b" from the upper side "a" in the direction of the axis x. Assuming that the outer diameter of the outer peripheral surface of the hub outer peripheral wall part 271 is "a1", and the outer diameter of the outer peripheral surface of the base outer peripheral wall part 124 is "b1", 1.05<b1/a1<1.13 is established.

5 Claims, 6 Drawing Sheets

(56) References Cited

U.S. PATENT DOCUMENTS

| | | | | |
|---|---|---|---|---|
| 2007/0080604 | A1* | 4/2007 | Yang | F04D 25/064<br>310/257 |
| 2010/0158713 | A1* | 6/2010 | Suzuki | F04D 29/5853<br>417/366 |
| 2014/0064941 | A1* | 3/2014 | Parodi | F04D 25/082<br>415/177 |

* cited by examiner

FAN DEVICE

CROSS REFERENCE TO RELATED APPLICATIONS

This application claims the benefit of Japanese Patent Application No. 2019-126657, filed Jul. 8, 2019 and Japanese Patent Application No. 2020-001901, filed Jan. 9, 2020, which is hereby incorporated by reference in its entirety.

BACKGROUND

Technical Field

The present disclosure relates to a fan device.

Background

As a fan device, an axial flow fan is used for a wide range of applications, such as cooling, ventilating, air conditioning, or blowing, in electronic equipment, home appliances, office automation equipment, industrial equipment, and vehicles. For the axial flow fan, for example, a heat radiation structure of a fan is known where a pillow part provided on a fan base forms a ventilation port and a flow path on a side opposite to an impeller boss so that a part of an air flow generated by a fan is introduced into the impeller boss, thus performing heat radiation of the entire motor (see Japanese Patent Laid-Open No. 2006-177309 (patent document 1)).

SUMMARY

In the fan device, a circuit board is provided in a motor base part on which a motor which rotates the impeller is mounted. Electronic components for forming a control circuit, which controls the operation of the motor, are mounted on the circuit board. In a conventional fan device, the circuit board is mounted in the motor base part such that the circuit board does not protrude outward in the radial direction from the outer periphery of the hub of the impeller so as not to inhibit an air flow generated with the rotation of the impeller.

However, in the case where the circuit board is mounted in the motor base part as described above, a sufficient amount of air flow is not introduced into the inside of the motor base part for the circuit board in the conventional fan device. Therefore, in the conventional fan device, when the amount of heat generated from electronic components mounted on the circuit board increases, the heat is confined in the motor base part so that the temperature of the circuit board increases and, as a result, lifespan of the fan device is shortened.

Further, in the heat radiation structure of a fan disclosed in patent document 1, the pillow part provided on the fan base, which acts as the motor base part, forms the ventilation port and the flow path on the side opposite to the impeller boss, which acts as the hub. Accordingly a part of an air flow generated with the rotation of the impeller is introduced into the impeller boss, thus performing heat radiation of the motor.

However, in the structure disclosed in patent document 1, the outer periphery of the pillow part protrudes outward in the radial direction from the outer periphery of the hub of the impeller. Therefore, in the structure disclosed in patent document 1, when heat radiation of the motor is promoted by increasing the protruding amount of the pillow part, the air flow is inhibited. As a result, the amount of air discharged from a discharge port of a housing is reduced so that fan efficiency is decreased.

The present disclosure is related to providing a fan device which can increase fan efficiency while increasing cooling performance for constitutional elements.

A fan device includes: an impeller including a hub and a plurality of blades provided on the hub; a motor configured to rotate the impeller; and a housing configured to accommodate the impeller, wherein the housing includes a motor base part which is formed into a cylindrical shape, and which covers the motor from a lower side in a direction of an axis, the motor base part includes a base body part and a base outer peripheral wall part, the base body part being a surface which extends in a radial direction orthogonal to the direction of the axis, and covering the motor from the lower side in the direction of the axis, and the base outer peripheral wall part extending from an end portion of the base body part toward an upper side from the lower side in the direction of the axis, the hub includes a hub body part and a hub outer peripheral wall part, the hub body part being a surface which extends in the radial direction orthogonal to the direction of the axis, and covering the motor from the upper side in the direction of the axis, and the hub outer peripheral wall part extending from an end portion of the hub body part toward the lower side from the upper side in the direction of the axis, and assuming that a diameter of an outer peripheral surface of the hub outer peripheral wall part is "a1", and a diameter of an outer peripheral surface of the base outer peripheral wall part is "b1", $1.05<b1/a1<1.13$ is established.

In the fan device according to one aspect of the present disclosure, a diameter of an inner peripheral surface of the base outer peripheral wall part is greater than the diameter of the outer peripheral surface of the hub outer peripheral wall part over an entire circumference.

In the fan device according to one aspect of the present disclosure, the hub body part has an exhaust port which penetrates in the direction of the axis.

In the fan device according to one aspect of the present disclosure, a gap part is provided between an inner peripheral surface of the motor base part and an outer peripheral surface of the hub.

In the fan device according to one aspect of the present disclosure, the housing includes a first housing and a second housing arranged in the direction of the axis, the first housing has an intake port which is open toward an upper side of the impeller, the second housing has a discharge port which is open toward a lower side of the impeller, and a part of an air flow which flows toward the discharge port from the intake port with rotation of the impeller is introduced into the motor base part from the gap part.

According to the fan device of the present disclosure, it is possible to increase fan efficiency while increasing cooling performance for constitutional elements.

DETAILED DESCRIPTION

Hereinafter, a fan device 1 according to an embodiment of the present disclosure will be described with reference to the accompanying drawings.

Figure 1:
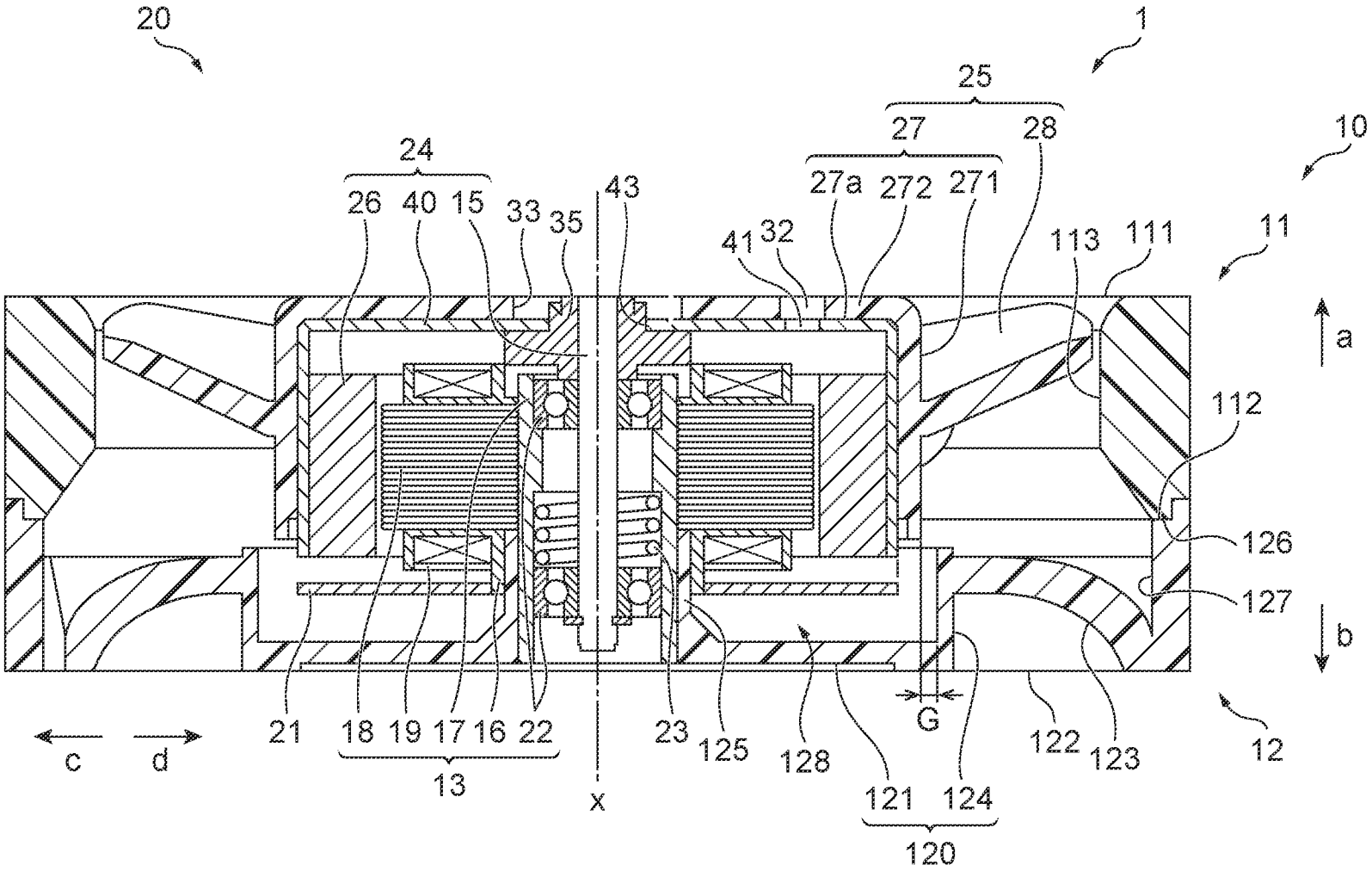
FIG. 1 is a cross-sectional view schematically showing a configuration of a fan device according to an embodiment of the present disclosure.
Figure 2:
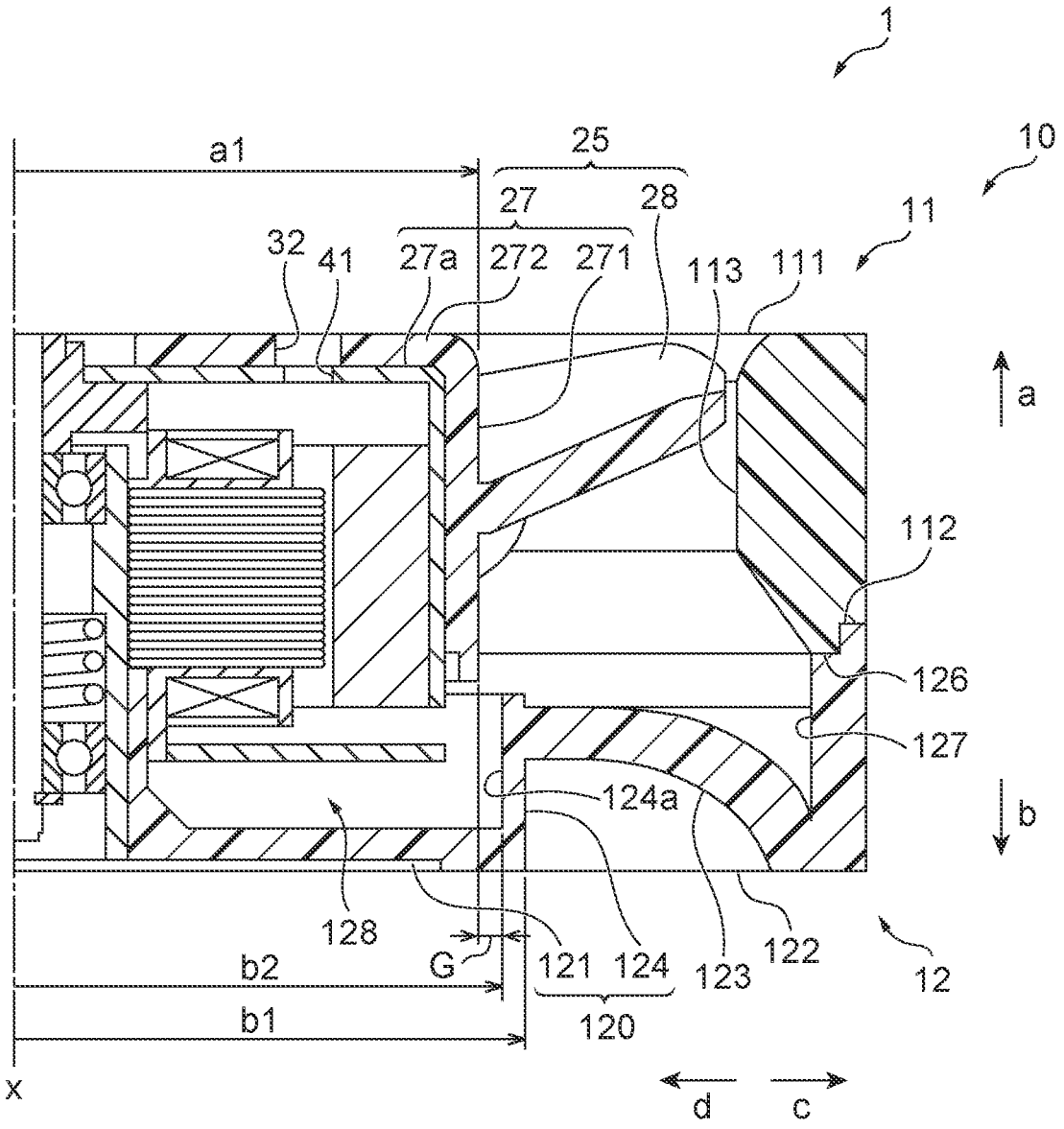
FIG. 2 is an enlarged cross-sectional view schematically showing the configuration of the fan device shown in FIG. 1.

FIG. 1 is a cross-sectional view schematically showing a configuration of the fan device 1 according to the embodiment of the present disclosure. FIG. 2 is an enlarged cross-sectional view schematically showing the configuration of the fan device 1 shown in FIG. 1.

In the description made hereinafter, for the sake of convenience, a direction indicated by an arrow "a" in a direction of an axis x is taken as an upper side "a", and a direction indicated by an arrow "b" is taken as a lower side "b". Further, in a radial direction perpendicular to the axis x, a direction away from the axis x (a direction indicated by an arrow "c" in FIG. 1) is taken as an outer peripheral side "c", and a direction toward the axis x (a direction indicated by an arrow "d" in FIG. 1) is taken as an inner peripheral side "d". In the description made hereinafter, for the sake of convenience, a side shown in FIG. 1 is assumed as the side surface of the fan device 1. Further, in the description made hereinafter, for the sake of convenience, the side of the fan device 1 when the fan device 1 is viewed from the upper side "a" toward the lower side "b" is assumed as a front surface, and a side of the fan device 1 when the fan device 1 is viewed from the lower side "b" toward the upper side "a" is assumed as a bottom surface.

As shown in FIG. 1 and FIG. 2, the fan device 1 according to the present embodiment includes a motor 20 which rotates a shaft 15, an impeller 25 mounted on the shaft 15, and a housing 10 which accommodates the impeller 25. The impeller 25 covers the motor 20 from the upper side "a" in the direction of the axis x. The impeller 25 includes a hub 27, and a plurality of blades 28 provided on the hub 27. A second housing 12 of the housing 10 includes a motor base part 120 which is formed into a cylindrical shape, and covers the motor 20 from the lower side "b" in the direction of the axis x. The motor base part 120 includes a base body part 121 and a base outer peripheral wall part 124. The base body part 121 is a surface extending in the radial direction orthogonal to the direction of the axis x, and the base body part 121 covers the motor 20 from the lower side "b" in the direction of the axis x. The base outer peripheral wall part 124 extends from the end portion of the base body part 121 toward the upper side "a" from the lower side "b" in the direction of the axis x. The hub 27 includes a hub body part 272 and a hub outer peripheral wall part 271. The hub body part 272 is a surface extending in the radial direction orthogonal to the direction of the axis x, and the hub body part 272 covers the motor 20 from the upper side "a" in the direction of an axis c. The hub outer peripheral wall part 271 extends from the end portion of the hub body part 272 toward the lower side "b" from the upper side "a" in the direction of the axis x. Assuming that the outer diameter of the outer peripheral surface of the hub outer peripheral wall part 271 is "a1", and the outer diameter of the outer peripheral surface of the base outer peripheral wall part 124 is "b1", $1.05<b1/a1<1.13$ is established. Hereinafter, the configuration and the operation of the fan device 1 will be specifically described.

[Configuration of Fan Device]

The fan device 1 includes, as main constitutional elements, the motor 20, the impeller 25, a first housing 11, and the second housing 12.

The impeller 25 is disposed about the axis x in the first housing 11 and the second housing 12. The impeller 25 includes the hub 27 having a cup shape, and the plurality of (five, for example) blades 28. The hub 27 is formed into a cylindrical or a substantially cylindrical shape which is open toward the lower side "b". The plurality of blades 28 extends in the circumferential direction from the hub outer peripheral wall part 271 provided on the outer peripheral surface of the hub 27. All blades 28 have the same shape, and are disposed equidistantly in the circumferential direction. The impeller 25 is formed such that the hub 27 and the blades 28 are integrally molded out of a resin.

The impeller 25 is caused to adhere to a rotor yoke 40 by an adhesive, for example. The impeller 25 has, on the surface of the hub body part 272 of the hub 27 on the upper side "a", first exhaust ports 32 which are a plurality of openings penetrating in the direction of the axis x. The rotor yoke 40 has second exhaust ports 41 penetrating in the direction of the axis x at the same position as the first exhaust ports 32 in the radial direction. The first exhaust ports 32 and the second exhaust ports 41 of the fan device 1 form exhaust ports which allow an air flow to flow between the inside and the outside of the impeller 25. Further, the impeller 25 has an opening part 33 at the center part of the hub body part 272 in the radial direction, and the opening part 33 allows the insertion of a part of a bush 35 which is coupled to the shaft 15.

The rotor yoke 40 may be integrally molded with the impeller 25 by insertion molding.

The motor 20 includes a stator 13 attached to the second housing 12 side in a fixed manner, and a rotor 24 attached to the impeller 25 side.

The rotor 24 includes the shaft 15, the rotor yoke 40, and a magnet 26. The shaft 15 is provided at the center part of the hub 27 via the bush 35 using the direction of the axis x as a longitudinal direction. The rotor yoke 40 is provided along an inner peripheral surface 27*a* of the hub 27. The magnet 26 is provided on the inner periphery side "d" of the rotor yoke 40. The rotor yoke 40 has an insertion hole 43 which allows the insertion of the bush 35 where the shaft 15 is coupled to the center part of the bush 35 in the radial direction. The rotor yoke 40 is swaged and fixed to the bush 35.

The stator 13 mainly includes an insulator 16, a bearing holder 17, a stator core 18, a coil 19, and bearings 22.

The insulator 16 is mounted on the stator core 18 from both sides, that is, from the upper side "a" and the lower side "b" of the stator core 18 in the direction of the axis. The bearing holder 17 is mounted on a boss part 125 of the second housing 12. The bearing holder 17 is a member made of metal (for example, brass), and having a hollow cylindrical shape. The bearing holder 17 is mounted on the boss part 125, made of a resin, by a proper method, such as press fitting. A pair of bearings 22 and a coil spring 23 are mounted in the space of the inner peripheral part of the bearing holder 17. The pair of bearings 22 rotatably supports the shaft 15. The coil spring 23 is provided for applying a preload to the bearing 22 on the lower side "b".

The stator core 18 is mounted on the outer periphery of the bearing holder 17. A circuit board 21 having a donut shape, for example, is attached to the lower side "b" of the stator core 18. Electronic components are mounted on the circuit board 21, and the electronic components form a control circuit which controls the operation of the motor 20 of the fan device 1. The stator core 18 is formed by stacking a plurality of cores made of a soft magnetic material (for example, electromagnetic steel sheet) in the direction of the axis x. The stator core 18 includes a plurality of salient poles extending outward in the radial direction from an annular part.

The coil 19 is wound around each salient pole of the stator core 18 via the insulator 16. The circuit board 21 is attached to the lower side "b" of the insulator 16. The circuit board 21 is accommodated in the motor base part 120.

The first housing 11 is positioned on the intake side of the fan device 1, that is, on the upper side "a" in the direction of the axis x. The second housing 12 is positioned on the exhaust side of the fan device 1, that is, on the lower side "b" in the direction of the axis x. The first housing 11 and the second housing 12 are coupled to form one housing which accommodates the motor 20, the impeller 25 and the like, which are constitutional elements of the above-mentioned fan device 1. In the fan device 1, the housing 10 has a dual structure where the first housing 11 and the second housing 12 are coupled. Therefore, the degree of freedom in shape of the first housing 11 and the second housing 12 can be increased when a complicated shape, for example, the shape of an inner peripheral surface and the shape of fixed wings 123, is formed by molding using a mold.

The first housing 11 is formed to surround the impeller 25 from the outer peripheral side "c". The first housing 11 includes an intake port 111, a joint part 112, and an inner peripheral part 113.

The intake port 111 is open toward the upper side "a" of the impeller 25 to takes air into the impeller 25. The intake port 111 communicates with the inner peripheral part 113, and has an inclined surface whose diameter increases from the lower side "b" toward the upper side "a". The joint part 112 is formed into a shape which can be joined with a joint part of the second housing 12, which will be described later. As described above, the joint part 112 causes the first housing 11 and the second housing 12 to function as one housing.

The inner peripheral part 113 is a peripheral surface of the first housing 11 which faces the impeller 25. The inner peripheral part 113 has an inclined surface at a portion which faces the intake port 111 side, which is the upper side "a" of the first housing 11, and the inner peripheral part 113 has an inclined surface at a portion which faces the upper side "a" of the second housing 12, which is disposed in the vicinity of the joint part 112, and which will be described later. The portion of the inner peripheral part 113 which faces the upper side "a" of the second housing 12 is formed such that the diameter of the portion continuously formed with the inclined surface increases.

The second housing 12 is formed into a shape which surrounds the circuit board 21 from the outer peripheral side "c". The second housing 12 includes the motor base part 120, the base body part 121, a discharge port 122, the fixed wings 123, the base outer peripheral wall part 124, a joint part 126, an inner peripheral part 127, and a board accommodating part 128.

The motor base part 120 covers the motor 20 from the lower side "b" in the direction of the axis x. The motor base part 120 includes the base body part 121 and the base outer peripheral wall part 124 having a standing wall shape. The base body part 121 is formed of a surface extending in the radial direction orthogonal to the direction of the axis x. The base outer peripheral wall part 124 is formed to extend from the end portion of the base body part 121 from the lower side "b" toward the upper side "a" in the direction of the axis x. The base body part 121 is formed into a circular shape or a substantially circular shape centered on the axis x. The motor base part 120 is formed into a cylindrical or a substantially cylindrical shape which uses the base body part 121 as a bottom surface, which uses the base outer peripheral wall part 124 as a side surface, and which is open toward the upper side "a". The motor base part 120 has the board accommodating part 128 on the inner peripheral surface of the motor base part 120 having a cylindrical or a substantially cylindrical shape, and the board accommodating part 128 can accommodate the circuit board 21.

FIG. 2 is an enlarged cross-sectional view schematically showing the configuration of the fan device 1 shown in FIG. 1. Further, FIG. 3 is a schematic view schematically showing the relationship between diameters (an outer diameter b1, an inner diameter b2) of the base outer peripheral wall part 124 of the fan device 1 and the diameter (outer diameter a1) of the hub outer peripheral wall part 271 of the fan device 1.

Figure 3:
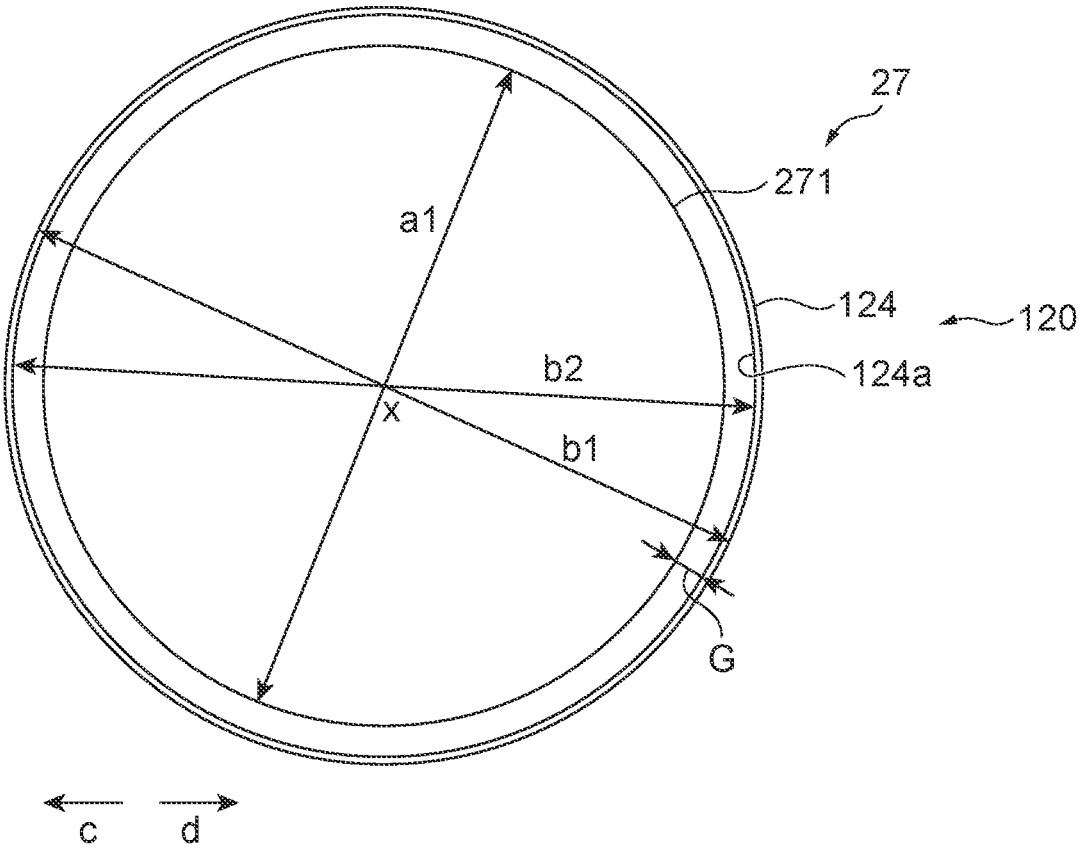
FIG. 3 is a schematic view schematically showing the relationship between diameters of a base outer peripheral wall part of the fan device shown in FIG. 1 and a diameter of a hub outer peripheral wall part of the fan device shown in FIG. 1.

As shown in FIG. 2 and FIG. 3, the outer diameter b1 of the base outer peripheral wall part 124 of the motor base part 120 is greater than the diameter of the outer peripheral surface of the hub outer peripheral wall part 271 of the hub 27 of the impeller 25, that is, greater than the outer diameter a1. Further, although the base outer peripheral wall part 124 has a predetermined thickness in the radial direction, the diameter of an inner peripheral part 124*a*, that is, the inner diameter b2 is also is greater than the outer diameter a1 of the hub outer peripheral wall part 271. In the present embodiment, the motor base part 120 and the hub 27 of the impeller 25 are formed into a cylindrical or a substantially cylindrical shape as described above. Therefore, the inner diameter b2 of the base outer peripheral wall part 124 is greater than the outer diameter a1 of the hub outer peripheral wall part 271 over the entire circumference about the axis x.

Due to a difference between the outer diameter b1 and the inner diameter b2 of the base outer peripheral wall part 124 and the outer diameter a1 of the hub outer peripheral wall part 271, the fan device 1 has a gap part G formed between the inner peripheral surface of the base outer peripheral wall part 124 of the motor base part 120 and the hub outer peripheral wall part 271. As shown in FIG. 2, the gap part G is open toward the upper side "a" of the fan device 1, that is, toward the intake port 111 side. Therefore, a part of the air flow fed toward the discharge port 122 by the blades 28 of the impeller 25 is introduced into the board accommodating part 128 formed on the inner periphery side "d" of the gap part G.

The discharge port 122 is open toward the upper side "a" of the impeller 25 to discharge air, taken into the housing 10 from the intake port 111, to the outside of the fan device 1. The discharge port 122 communicates with the inner peripheral part 113 of the first housing 11 and the inner peripheral part 127 of the second housing 12. The joint part 126 is formed into a shape which can be joined with the joint part 112 of the first housing 11 and, as described above, the joint part 126 causes the first housing 11 and the second housing 12 to function as one housing.

A plurality of fixed wings 123 are formed on the outer peripheral surface of the motor base part 120, which is formed into a circular shape or a substantially circular shape, on the discharge port 122 side, which is the lower side "b" of the second housing 12. The fixed wings 123 extend from the outer peripheral surface of the motor base part 120 toward the outer peripheral side "c" in the radial direction, and are coupled to the inner peripheral part 127 of the second housing 12. The second housing 12, the motor base part 120, and the fixed wings 123 are integrally molded out of a resin.

The inner peripheral part 127 is a peripheral surface of the second housing 12 which faces the impeller 25. The inner diameter of the inner peripheral part 127 is constant in the direction of the axis x. The diameter of the inner peripheral part 127 of the second housing 12 is greater than the diameter of the inner peripheral part 113 of the first housing 11 in which the blades 28 of the impeller 25 rotate. The fan device 1 is configured such that the diameters of the inner peripheral parts 113, 127 are increased as a portion progresses from the intake port 111 toward the discharge port 122 to increase a pressure (static pressure).

[Operation of Fan Device]

Next, the operation of the fan device 1 having the above-described configuration will be described.

Figure 4:
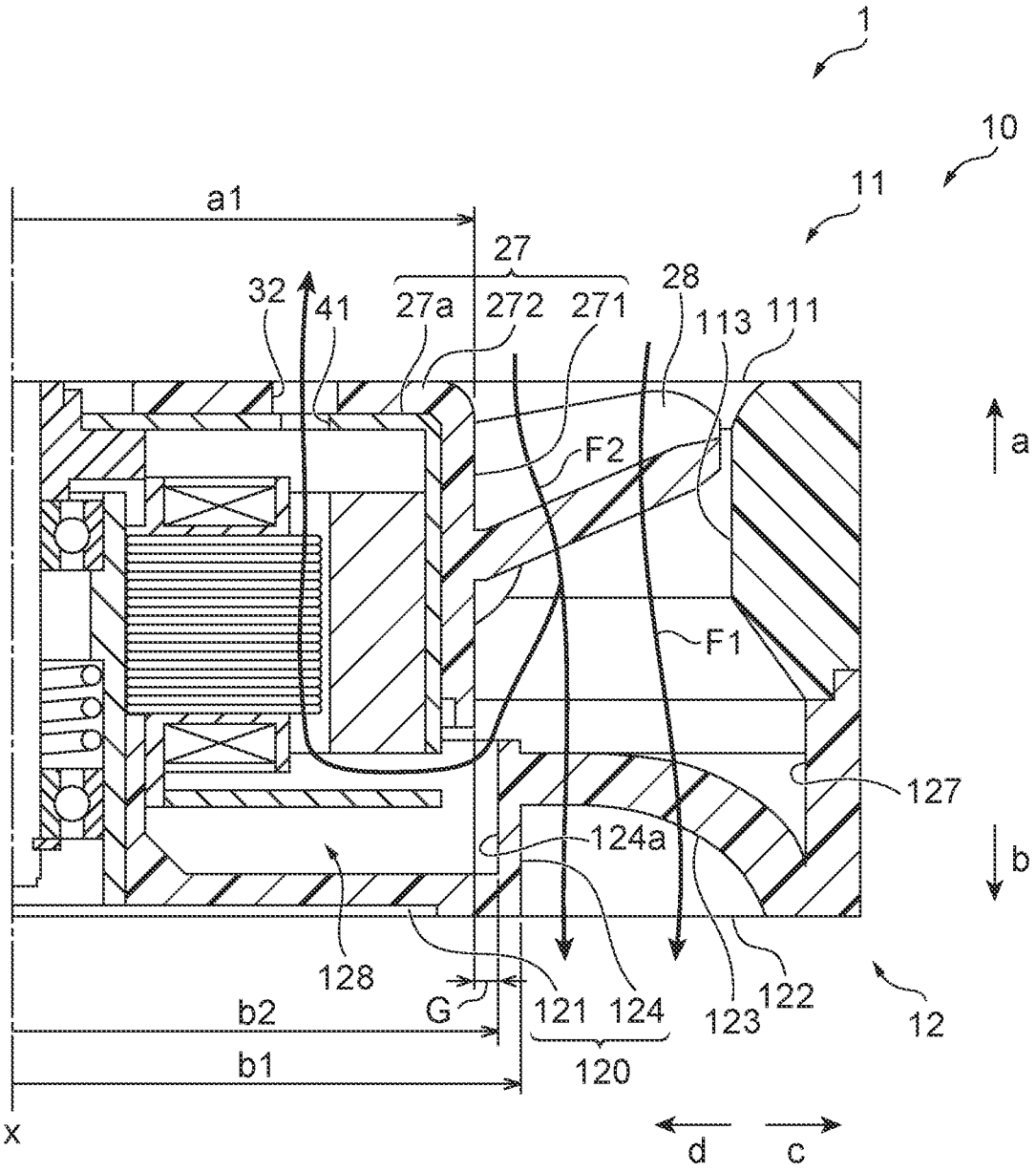
FIG. 4 is an enlarged cross-sectional view schematically showing an air flow in the fan device shown in FIG. 1.

FIG. 4 is an enlarged cross-sectional view schematically showing an air flow in the fan device 1. As shown in FIG. 4, the motor 20 rotates the rotor 24 against the stator 13, thus rotationally driving the impeller 25. When the impeller 25 is rotated by the motor 20, the plurality of blades 28 provided on the impeller 25 generate an air flow which flows from the intake port 111 of the first housing 11, which is open toward the upper side "a" of the impeller 25, toward the discharge port 122, which is open toward the lower side "b" of the second housing 12, and which is discharged to the outside through between the fixed wings 123.

The motor base part 120 is formed such that the outer diameter b1 of the motor base part 120 is greater than the outer diameter a1 of the hub outer peripheral wall part 271 of the hub 27 of the impeller 25. Further, the motor base part 120 is formed such that the inner diameter b2 of the motor base part 120 is greater than the outer diameter a1 of the hub outer peripheral wall part 271 of the hub 27 of the impeller 25. Therefore, in the fan device 1, when the impeller 25 is rotated, air flows F1, F2 are caused to pass through between the blades 28, and are discharged from the discharge port 122. Of the air flows F1, F2, a part of the air flow F2 which flows along the hub outer peripheral wall part 271 is introduced into the board accommodating part 128 of the motor base part 120 from the gap part G. In the fan device 1, the electronic components mounted on the circuit board 21 are cooled by the air flow F2 which is introduced into the motor base part 120 so that heat radiation is promoted.

Figure 5:
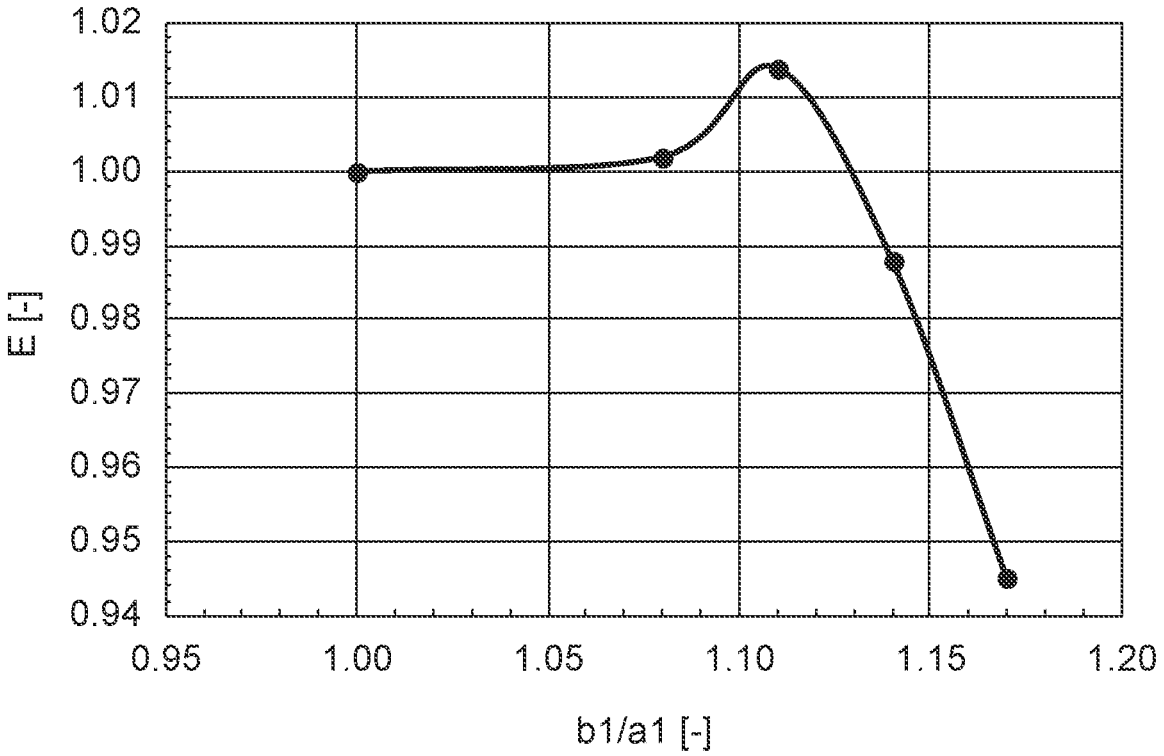
FIG. 5 is a graph showing the relationship, in the fan device shown in FIG. 1, between a ratio of the outer diameter of a motor base part to the outer diameter of a hub and fan efficiency.

FIG. 5 is a graph showing the relationship, in the fan device 1, between a ratio b1/a1 of the outer diameter b1 of the motor base part 120 to the outer diameter a1 of the hub 27 and fan efficiency E. The fan efficiency E is indicated by a ratio using, as the reference, the fan efficiency E at which the ratio b1/a1 of the outer diameter b1 of the motor base part 120 to the outer diameter a1 of the hub 27 is 1.

As shown in FIG. 5, when the ratio b1/a1 falls within a range from 1 to 1.05, the fan efficiency E is hardly changed. Whereas, when the ratio b1/a1 becomes 1.05 or more, the fan efficiency E increases and, when the ratio b1/a1 is approximately 1.105, the fan efficiency E reaches the maximum value. After the fan efficiency E reaches the maximum value, the fan efficiency E decreases and, when the ratio b1/a1 becomes approximately 1.13, the fan efficiency E has a value substantially equal to a value before the fan efficiency E is changed, that is, a value at which the ratio b1/a1 is 1 to 1.05.

As described above, in the fan device 1, the range of the ratio b1/a1 which can increase the fan efficiency E is $1.05<b1/a1<1.13$. In the fan device 1, it is preferable to set the ratio to satisfy $1.09<b1/a1<1.12$. With such setting, the circuit board 21 can be cooled more, and the fan efficiency E can also be increased.

To cause the fan device 1 to have the gap part G for introducing an air flow into the board accommodating part 128 of the motor base part 120, the inner diameter b2 of the inner peripheral surface of the base outer peripheral wall part 124 of the motor base part 120 is required to be greater than the outer diameter a1 of the hub outer peripheral wall part 271. Therefore, it is desirable to set the outer diameter b1 of the base outer peripheral wall part 124 by taking into account the thickness (for example, approximately 1 mm) of the base outer peripheral wall part 124. Depending on a method for molding the motor base part 120, or mechanical strength of the base outer peripheral wall part 124, the thickness of the base outer peripheral wall part 124 is not limited to the above-mentioned approximately 1 mm. It is sufficient that the thickness of the base outer peripheral wall part 124 falls within a predetermined numerical range (0.5 to 1.5 mm), for example. Further, it is desirable to set the outer diameter b1 of the base outer peripheral wall part 124 by taking into account the above-mentioned numerical range of the thickness of the base outer peripheral wall part 124.

The fan device 1 has the first exhaust ports 32 and the second exhaust ports 41 as exhaust ports which penetrates in the direction of the axis x between the inside and the outside of the hub 27. The first exhaust ports 32 are provided in the hub body part 272. The second exhaust ports 41 are provided in the rotor yoke. The first exhaust ports 32 and the second exhaust ports 41 allow the air flow F2, introduced into the board accommodating part 128 of the motor base part 120 from the gap part G, to be discharged to the outside of the hub 27 again while allowing the air flow F2 to pass through the motor 20 provided in the hub 27.

Figure 6:
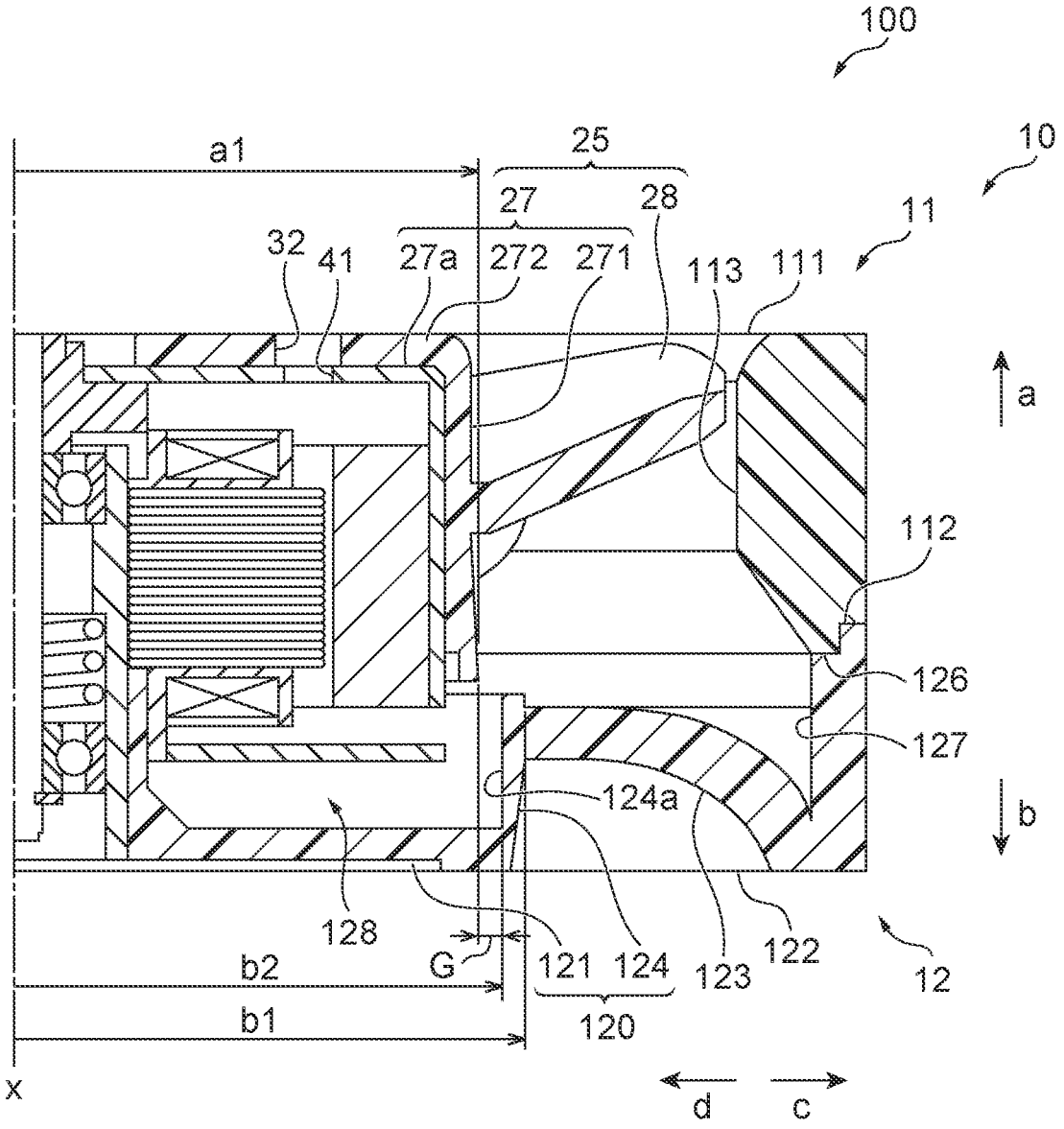
FIG. 6 is an enlarged cross-sectional view schematically showing a configuration of a fan device according to another embodiment of the present disclosure.

FIG. 6 is an enlarged cross-sectional view schematically showing the configuration of a fan device 100 according to another embodiment of the present disclosure. As shown in FIG. 6, in the case where the hub outer peripheral wall part 271 is formed in an inclined manner to have a tapered shape or the like, the outer diameter a1 of the hub outer peripheral wall part 271 of the hub 27 of the fan device 100 is defined at the lower end of the hub outer peripheral wall part 271, which is a portion opposing the base outer peripheral wall part 124. Further, in the case where the base outer peripheral wall part 124 is formed in an inclined manner to have a tapered shape or the like, the outer diameter b1 of the base outer peripheral wall part 124 of the motor base part 120 is defined at the upper end of the base outer peripheral wall part 124, which is a portion opposing the hub outer peripheral wall part 271.

According to the fan device having the above-mentioned configuration, it is possible to increase fan efficiency while increasing cooling performance for constitutional elements.

In addition to the above, those who are skilled in the art may appropriately modify the fan device of the present disclosure according to the conventionally known knowledge. It is needless to say that such modification also falls within the scope of the present disclosure provided that the modification has the configuration of the present disclosure.

What is claimed is:

1. A fan device comprising:

an impeller including a hub and a plurality of blades provided on the hub;

a motor configured to rotate the impeller; and a housing configured to accommodate the impeller, wherein the housing includes a motor base part which is formed into a cylindrical shape, and which covers the motor from a lower side in a direction of an axis, the motor base part includes a base body part and a base outer peripheral wall part, the base body part being a surface which extends in a radial direction orthogonal to the direction of the axis, and covering the motor from the lower side in the direction of the axis, and the base outer peripheral wall part extending from an end portion of the base body part toward an upper side from the lower side in the direction of the axis, the hub includes a hub body part and a hub outer peripheral wall part, the hub body part being a surface which extends in the radial direction orthogonal to the direction of the axis, and covering the motor from the upper side in the direction of the axis, and the hub outer peripheral wall part extending from an end portion of the hub body part toward the lower side from the upper side in the direction of the axis, and assuming that a diameter of an outer peripheral surface of the hub outer peripheral wall part is "a1", and a diameter of an outer peripheral surface of the base outer peripheral wall part is "b1", $1.05<b1/a1<1.13$ is established.

2. The fan device according to claim 1, wherein a diameter of an inner peripheral surface of the base outer peripheral wall part is greater than the diameter of the outer peripheral surface of the hub outer peripheral wall part over an entire circumference.

3. The fan device according to claim 1, wherein the hub body part has an exhaust port which penetrates in the direction of the axis.

4. The fan device according to claim 1, wherein a gap part is provided between an inner peripheral surface of the motor base part and an outer peripheral surface of the hub.

5. The fan device according to claim 4, wherein the housing includes a first housing and a second housing arranged in the direction of the axis, the first housing has an intake port which is open toward an upper side of the impeller, the second housing has a discharge port which is open toward a lower side of the impeller, and a part of an air flow which flows toward the discharge port from the intake port with rotation of the impeller is introduced into the motor base part from the gap part.

* * * * *